US007545337B2

(12) United States Patent
Guenther

(10) Patent No.: US 7,545,337 B2
(45) Date of Patent: Jun. 9, 2009

(54) ANTENNA ARRANGEMENT FOR INDUCTIVE POWER TRANSMISSION AND USE OF THE ANTENNA ARRANGEMENT

(75) Inventor: Wulf Guenther, Maintal (DE)

(73) Assignee: Vacuumscmelze GmbH & Co. KG, Hanau (DE)

( * ) Notice: Subject to any disclaimer, the term of this patent is extended or adjusted under 35 U.S.C. 154(b) by 0 days.

(21) Appl. No.: 11/559,171

(22) Filed: Nov. 13, 2006

(65) Prior Publication Data

US 2007/0126650 A1 Jun. 7, 2007

Related U.S. Application Data

(63) Continuation of application No. PCT/EP2005/005271, filed on May 13, 2005.

(30) Foreign Application Priority Data

May 13, 2004 (DE) ..... 10 2004 023 815

(51) Int. Cl.
*H01Q 7/08* (2006.01)

(52) U.S. Cl. ..... 343/788; 343/787

(58) Field of Classification Search ..... 343/787, 343/788

See application file for complete search history.

(56) References Cited

U.S. PATENT DOCUMENTS

| | | | | |
|---|---|---|---|---|
| 3,949,388 | A * | 4/1976 | Fuller | 340/870.17 |
| 4,881,989 | A | 11/1989 | Yoshizawa et al. | 148/302 |
| 5,160,379 | A | 11/1992 | Yoshizawa et al. | 148/108 |
| 6,443,212 | B1 | 9/2002 | Choudhury et al. | 164/118 |
| 6,630,831 | B2 * | 10/2003 | Amini | 324/339 |
| 6,825,751 | B1 * | 11/2004 | Kita et al. | 340/5.61 |
| 6,906,495 | B2 | 6/2005 | Cheng et al. | 320/108 |
| 6,930,646 | B2 | 8/2005 | Yahata et al. | 343/718 |
| 7,265,651 | B2 | 9/2007 | Brunner | 336/233 |
| 2003/0156000 | A1 | 8/2003 | Brunner | 336/96 |
| 2003/0210106 | A1 | 11/2003 | Cheng et al. | 333/24 |
| 2004/0183643 | A1 | 9/2004 | Brunner | 336/200 |
| 2007/0126650 | A1 | 6/2007 | Guenther | 343/788 |

FOREIGN PATENT DOCUMENTS

| | | | |
|---|---|---|---|
| DE | 19718423 | A1 | 11/1998 |
| DE | 69600910 | T2 | 7/1999 |
| DE | 19846781 | A1 | 4/2000 |
| EP | 0271657 | A2 | 10/1987 |
| EP | 0455113 | A2 | 4/1991 |

(Continued)

OTHER PUBLICATIONS

International Search Report and Written Opinion for International Application No. PCT/EP2005/005271 (10 pages), May 13, 2005.

(Continued)

*Primary Examiner*—Tho G Phan
(74) *Attorney, Agent, or Firm*—King & Spalding L.L.P.

(57) ABSTRACT

An antenna arrangement for the inductive transmission of energy has magnetic cores made of a composite material with amorphous or nanocrystalline flakes and a moulded plastic material, so that the magnetic properties suitable for effective energy transmission can be adjusted at the same time as high security against fracture and a small overall height are achieved.

19 Claims, 2 Drawing Sheets

FOREIGN PATENT DOCUMENTS

| | | | |
|---|---|---|---|
| EP | 0762535 | A1 | 8/1996 |
| EP | 1496568 | A1 | 1/2005 |
| WO | 01/91141 | A1 | 11/2001 |
| WO | 0191141 | | 11/2001 |
| WO | 02/101763 | A1 | 12/2002 |
| WO | 02101793 | | 12/2002 |
| WO | 2005112192 | | 11/2005 |

OTHER PUBLICATIONS

Notification of Transmittal of Copies of Translation of the International Preliminary Report on Patentability of International Application No. PCT/EP2005/005271 (9 pages), Dec. 14, 2006.
International Search Report; PCT/EP2005/005271; pp. 10.

* cited by examiner

ANTENNA ARRANGEMENT FOR INDUCTIVE POWER TRANSMISSION AND USE OF THE ANTENNA ARRANGEMENT

CROSS-REFERENCE TO RELATED APPLICATION

This application is a continuation of co-pending International Application No. PCT/EP2005/005271 filed May 13, 2005, which designates the United States, and claims priority to German application number DE 10 2004 023 815.4 filed May 13, 2004.

TECHNICAL FIELD

The invention refers to an antenna arrangement with an open magnet core and a coil.

BACKGROUND

The invention has been made in the field of magnetic field antennae used for inductive power transmission. Principally, it is possible to transmit power and information via electric or magnetic dipoles. In this process, electromagnetic waves or mostly electric or magnetic fields are generated depending upon the control circuit. It would be advantageous if no electromagnetic waves are radiated and if only magnetic fields are generated; this would avoid the influence on the organic web around the antenna. Another advantage would be that relatively high energies will be transmitted to a magnetic antenna without a galvanic coupling because of the radiation of magnetic fields and/or inductive coupling. The effect of such a coupling is restricted to a very small area less than approx. Im. In spite of this, there are several application possibilities for such a transmission.

Apart from the commonly used soft ferrites, most of the known soft magnetic powder composite materials can be used as pressed magnet cores. For example, these can be made up of iron powder. With magnet cores of such type, an effective permeability ranging from 10 to 30 can be achieved. Corresponding saturation inductions can range from 1.0 to 1.4 T. Apart from this, powder composite materials made from soft magnetic crystalline iron-aluminum-silicone alloys and iron-nickel alloys are known; application frequencies of more than 100 kHz can be achieved with these.

A disadvantage of such composite materials and ferrites is that the pressing technologies only allow simple geometric forms and that the resultant magnet cores are relatively brittle and likely to break. Also, the corresponding magnetic properties are very much dependent upon the temperature, which makes the use of resonant circuits more difficult.

According to DE 19846781 A1, magnet cores are known, which are formed with the injection casting method from plastic (which can be injection cast) and a nano-crystalline alloy.

Corresponding nano-crystalline alloys are also described in, for example, EP 0271657 A2 and EP 0455113 A2. Such alloys are manufactured in the form of thin alloy strips, for example, with the quick-setting technology. These alloys are initially amorphous and are hence, subjected to a heat treatment so that a nano-crystalline structure can be obtained. Such alloys can be ground to alloy powders with particle size less than 2 mm. Usually, these so-called flakes have a thickness ranging from 0.01 to 0.04 mm and width and length ranging from 0.04 to 1 mm per particle. With the help of plastics, these flakes can be processed to form composite materials, whereby saturation magnetizations of more than 0.5 Tesla and permeability ranging from 10 to 200 can be obtained. A method of forming such magnet cores is described in WO 0191141 A1.

In EP 0762535 A1, there are antennae made up of soft magnetic powder composite materials, e.g. amorphous alloys, for transponders. Such antennae are used for exchanging information. They ensure a fail-safe exchange of information over an area of several meters as well as less interference with metallic objects in the vicinity of the antennae.

SUMMARY

This invention is based on providing an antenna arrangement for the use of inductive power transmission.

This invention aims at an effective power transmission in the near field area and a reliable functioning irrespective of the exact positioning of the antenna arrangement against the receiver, to which the inductive power transmission must take place. For this, certain magnetic properties, a sufficient flow with appropriate radiation in particular, are necessary for the antenna arrangement.

With the help of a type compliant antenna arrangement, outputs ranging from approx. 1 W to 100 W must be transmitted from a transmitter to the receiver over a distance of approx. 0.5 to 50 cm. Such transmissions can be used, for example, in devices that have to be occasionally or constantly supplied power in a wireless manner. Because of the exclusive inductive coupling, a frequency range of 10 kHz to 150 kHz is particularly suitable due to the availability of this frequency band and the dimensional marginal conditions. Also, a magnetic flow of at least 20 μWb must be realized in the magnet core.

Since such antennae, as they are used in this antenna arrangement, mostly represent the inductive part of a resonant circuit, a high antenna quality of at least 50, preferably also 100 in the area of the operating frequency, is desirable for optimizing the power radiation. Besides, a temperature-dependent permeability between 30 and 200 is essential for an optimum flow. When the permeability is high, the directionality of the flow in the core is so good that a very little flow is given out from the core laterally and the field intensity along the core, i.e. in the receiving area, is extremely inhomogeneous.

The object of this invention cannot be satisfactorily resolved with the known magnetic arrangements, magnet cores and materials.

This object can be achieved by an antenna arrangement comprising a magnet core and a winding for use in the inductive power transmission, wherein the magnet core contains a soft magnetic component made of finely divided particles and a plastic component as the composite material and wherein the magnet core has an effective initial permeability ranging from 20 to 200 as well as a saturation induction higher than 0.6 T.

BRIEF DESCRIPTION OF THE DRAWINGS

The invention is explained in detail below with the help of design examples shown in the figures in the drawing.

DETAILED DESCRIPTION

Figure 1:
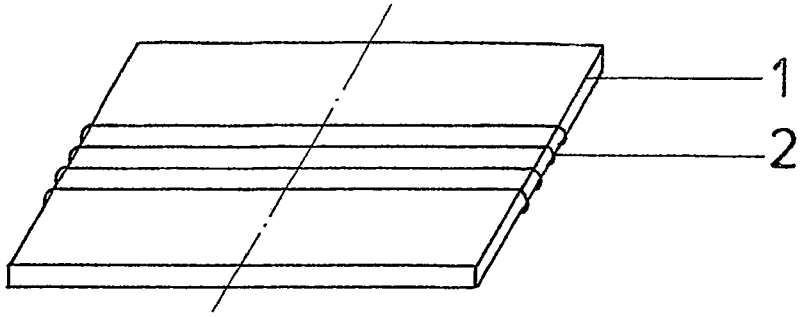
FIG. 1 A plate-shaped rectangular design of a magnet core with a winding.

In an embodiment, the soft magnetic component may comprise an amorphous or a nano-crystalline material. In an embodiment, the soft magnetic component may comprise particles which are individually insulated with a surface layer. In an embodiment, the particle size can be less than 2 mm. In an embodiment, the particle thickness can be less than 0.5 mm. In an embodiment, the surface of the particles can be oxidized or plastic coated. In an embodiment, the plastic component may comprise thermoplastic or duroplastic which can be processed with a casting resin technology. In an embodiment, the antenna formed by the magnet core and winding may have a quality more than 50 in the frequency range from 20 kHz to 150 kHz. In an embodiment, the magnet core can be loaded with a magnetic flow of at least 20 μWb. In an embodiment, the antenna may comprise several windings on the same magnet core, wherein the longitudinal axes of the windings are arranged at an angle greater than 0° to one another. In an embodiment, the antenna may comprise several magnet cores that carry windings, wherein the radiation properties of the individual magnet cores are shaped and/or aligned differently. In an embodiment, at least one of the magnet cores may have a recess for accommodating electronic components.

Yet another embodiment is directed to a method of using an antenna for inductive power transmission, wherein the antenna comprises a magnet core and a winding for use in the inductive power transmission, wherein the magnet core contains a soft magnetic component made of finely divided particles and a plastic component as the composite material and wherein the magnet core has an effective initial permeability ranging from 20 to 200 as well as a saturation induction higher than 0.6 T.

In an embodiment, the method may be used for inductive power transmission between a stationary device and a mobile device fitted with an inductive receiver. In an embodiment, the method may be used for charging the power stores in the mobile devices. In an embodiment, the method may be used for inductive power transmission from a mobile device to a stationary device.

Yet another embodiment is directed to a method for operating an antenna comprising a plurality of magnet cores each carrying at least one winding, wherein the radiation properties of the individual magnet cores are shaped and/or aligned differently, wherein each magnet core contains a soft magnetic component made of finely divided particles and a plastic component as the composite material and wherein each magnet core has an effective initial permeability ranging from 20 to 200 as well as a saturation induction higher than 0.6 T, wherein the method may comprise the step of controlling different windings in a simultaneously phased manner or in an alternating manner.

Yet another embodiment is directed to a method for operating an antenna comprising a magnet core having a plurality of winding for use in the inductive power transmission, wherein longitudinal axes of the windings are arranged at an angle greater than 0° to one another, and wherein the magnet core contains a soft magnetic component made of finely divided particles and a plastic component as the composite material and wherein the magnet core has an effective initial permeability ranging from 20 to 200 as well as a saturation induction higher than 0.6 T, wherein the method comprises the step of controlling different windings in a simultaneously phased manner or in an alternating manner.

According to the invention, the magnet core contains a soft magnetic component made from finely distributed particles and a plastic component as the composite material; the magnet core has an initial permeability between 20 and 200 and a saturation induction of >0.6 T.

An advantage is that, the soft magnetic component is made up of the flakes of a nano-crystalline material as mentioned above. This component has a saturation magnetization of approx. 1 to 1.6 T and permeability>30,000. By mixing a plastic component, the magnetic circuit is broken because of the microscopic gaps between the flakes and a lower effective permeability of 30 to 100 is achieved at a high quality and constancy of temperature. However, a high flow density is achieved, higher than 0.6 T, typically also higher than 0.9 T. A favorable property of the soft magnetic component of the magnet core is that the particles are electrically insulated with a surface layer. This can be, for example, a plastic layer or the result of surface oxidation. The particle size can be less than 2 mm, whereby the particle thickness can be less than 0.5 mm. Because of this form of the particles, there are very little magnetic losses and thus, a very high quality of antennae is achieved. The mechanical properties—fracture toughness, flexibility and temperature dependability—can be adapted according to the type and proportion of plastic used.

Thermoplastics or duroplastics such as polyamide, polyacrylate, polyacetate, polyimide or epoxy resin processed with the casting resin technology can be used as the plastic component, depending upon the required mechanical and thermal properties.

In the simplest design, the antenna arrangement has a bar or a plate with a winding as the magnet core. Definite core cross-sections are necessary so that the arrangement can be used for an effective power transmission. If an average flow of at least 20 μWb is attained in the core, an induction of 400 mT is achieved for a cross-section of 0.5 $cm^2$. This corresponds to approximately half of the cross-section required for the use of a soft ferrite.

In this case, the coil length should be greater than the diameter of the winding so that the magnet core can be effectively used for increasing the flow. An important property of the material used as per this invention is the mechanical immunity to impacts and vibrations and flexibility in shaping during the production and/or subsequent flexibility. Because of its magnetic properties, the material used as per this invention has a small size and can thus, be used in several areas of application due to cost, space and design reasons.

For achieving the desired radiation properties and/or flow of the antenna arrangement, it can be advantageous if several windings are arranged on the same magnet core, whereby the longitudinal axes of the windings are at an angle of >0°, e.g. 90° to one another. The windings can be controlled simultaneously, in a phased manner or in an alternating manner, so that inductive power transmission to the receiver can take place in different positions. Thus, power transmission becomes more reliable and immune as regards the relative positioning of the transmitter and receiver. This invention is based on different operating methods of the antenna arrangement with intermittent functioning of the different windings and/or the aforementioned dephased simultaneous control of the different windings.

To achieve a high acceptance as regards the positioning of the transmitters and receivers, it is possible to have several windings on different magnet cores of the given type, whereby the radiation property of the individual magnet cores is shaped or adjusted differently. Also, this helps in increasing the optimum positioning range of a receiver, to which the power is transmitted.

Since the antenna arrangement as per this invention can be space-saving, it might also be logical to provide for a recess within a magnet core, in which electronic components, e.g. the control circuit of the antenna arrangement, can be accommodated. The flow within the magnet core will hardly be influenced by such recesses, provided they are not too large. Besides, the antenna arrangement can be pre-fabricated with the control circuit and easily incorporated as an integral unit in the device.

Figure 2:
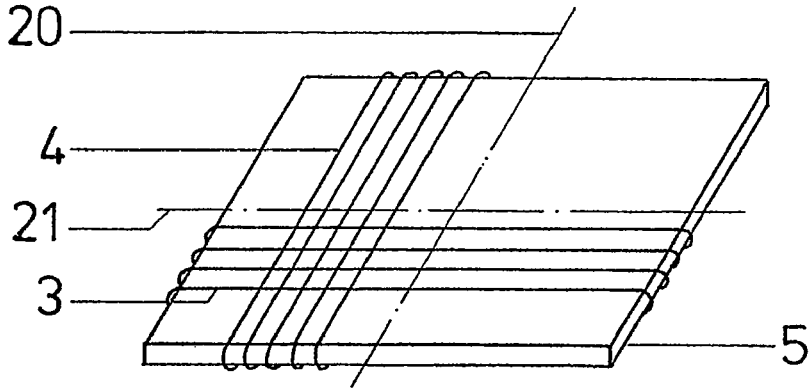
FIG. 2 A corresponding magnet core with two windings.

FIG. 1 shows a two-dimensional magnet core 1 with a winding 2, whereby the dimensions of the magnet core can be, e.g. 20 ×10 ×0.2 cm. Preferably, the area of the core is as big as the target place (to be covered) of the receiver. Because of the design of the winding, e.g. a compaction/compression towards the ends, a strong homogenous flow density is generated as far as possible. For specially designing the flow orientation and the radiation properties, FIG. 2 shows a combination of two perpendicular windings 3, 4 on a magnet core 5, which is almost designed as a quadratic plate. Both the windings can be controlled alternately or in a simultaneously dephased manner.

If the correct plastic component is selected, the entire arrangement can be flexible, as shown in FIG. 1 or 2. In any case, this component is more immune to fracture than e.g. an arrangement with ferrite core or a core made from any other material that is usually used.

Figure 3:
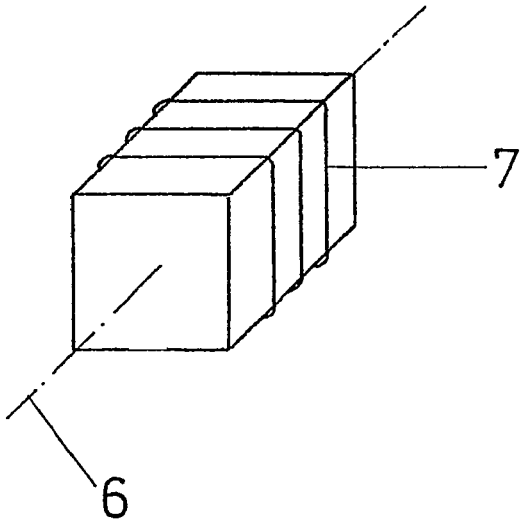
FIG. 3 A bar-shaped magnet core with two windings.

The arrangement with a bar-shaped magnet core as shown in FIG. 3 is particularly suitable for the transmission of power to a mobile receiver, whereby the direction of movement as well as the antenna of the receiver is parallel to the longitudinal axis of the winding 7.

Figure 6:
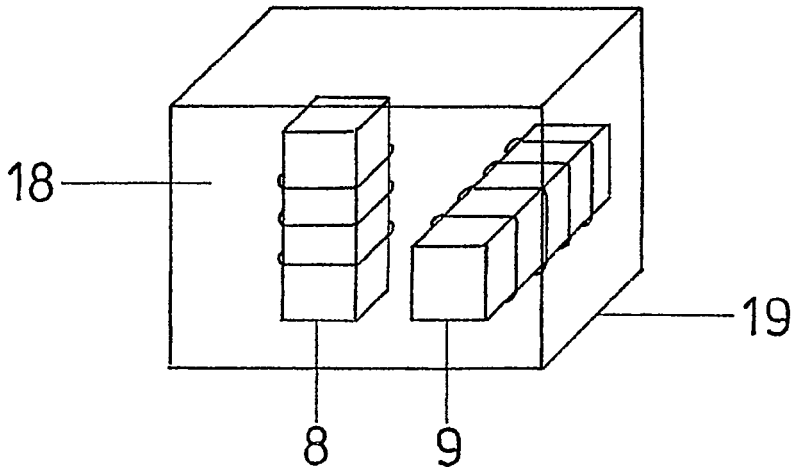
FIG. 6 An application of the antenna arrangement with two magnet cores.

FIG. 6 shows two different magnet cores 8, 9; each has a separate winding and their longitudinal axes are perpendicular so as to allow different flow densities and radiation properties. This is an alternative to the design shown in FIG. 2, which has several windings on a single magnet core.

Figure 4:
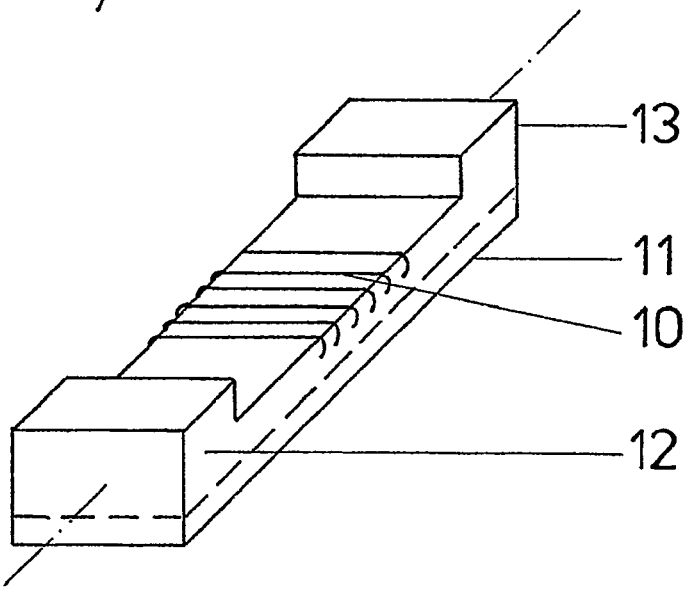
FIG. 4 A bar-shaped magnet core with an in-built winding and pole shoes.

FIG. 4 shows an arrangement, in which the winding 10 is integrated in a magnetic body 11, as if it is passing through the magnet core itself 11 and the lower part of the magnet core 11 shown in FIG. 4 forms a yoke, which shorts the magnetic flow on the lower side. This along with the pole shoes 12, 13 gives a screening effect in one direction (downward) as well as a good radiation in the upward direction.

The casting method described in WO 0191141 A1 is particularly suitable for making such an arrangement, whereby the winding can also be cast while preparing the magnet core.

Figure 5:
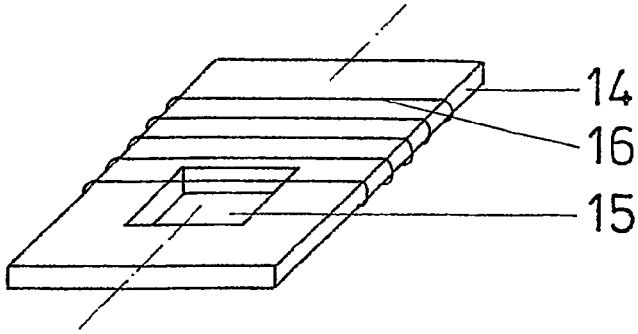
FIG. 5 A magnet core with recess.
Figure 5:
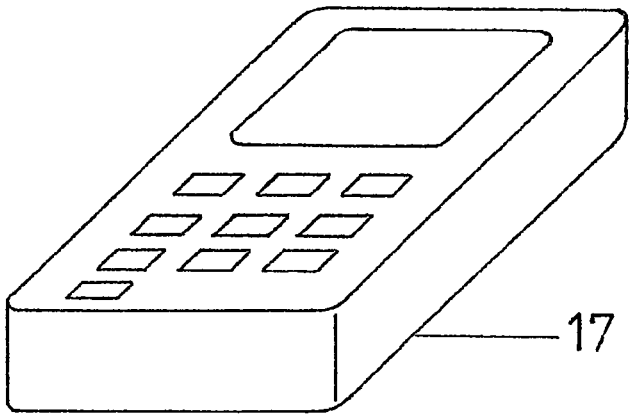

FIG. 5 shows a recess 15 in the magnet core 14, where components of an electronic circuit, e.g. for controlling the winding 16, can be accommodated.

FIG. 6 shows an example of application of the antenna arrangement with a mobile communication terminal unit as per this invention—such as a mobile phone or a cordless phone 17, which has a receiver for inductive coupling with the antenna arrangement 18 (not described in detail). The antenna arrangement 18 has a housing 19, which accommodates both the magnet cores 8, 9; each of these magnet cores has a winding and enable inductive power transmission to the receiver in the terminal unit 17. In addition to the receiver, a capacitor or accumulator is also integrated in the terminal unit 17 for storing the transmitted power.

Although the described antenna arrangement is specially meant for power transmission, the same arrangement can also be used for transmitting back information and/or a signal, which is possibly either transmitted in an inductive manner (whereby a changeover must take place between transmission and reception) or by evaluating the power drawn by the receiver.

The invention can also be used for power transmission from a mobile device to a stationary device, e.g. in the track system for transmitting signals and/or power from a device fixed on a vehicle to a stationary sensor in a control room/signal cabin for monitoring the traffic.

What is claimed is:

1. An antenna arrangement comprising an elongated magnet core and a cylindrical coil wound around the core, with a longitudinal axis of the coil parallel a length axis of the core, wherein the antenna is configured to transmit power inductively to one or more receivers positioned in a distance of about 0.5 cm to about 50 cm in any direction around the antenna arrangement, wherein the magnet core contains a soft magnetic component made of finely divided particles and a plastic component as the composite material and wherein the magnet core has an effective initial permeability ranging between 30 and 100 as well as a saturation induction higher than 0.6 T.

2. The antenna according to claim 1, wherein the soft magnetic component comprises an amorphous or a nanocrystalline material.

3. The antenna according to claim 1, wherein the soft magnetic component comprises particles which are individually insulated with a surface layer.

4. The antenna according to claim 3, wherein the surface of the particles is oxidized or plastic coated.

5. The antenna according to claim 3, wherein the particle size is less than 2 mm.

6. The antenna according to claim 3, wherein the particle thickness is less than 0.5 mm.

7. The antenna according to claim 1, wherein the particle size is less than 2 mm.

8. The antenna according to claim 1, wherein the particle thickness is less than 0.5 mm.

9. The antenna according to claim 1, wherein the plastic component comprises thermoplastic or duroplastic which can be processed with a casting resin technology.

10. The antenna according to claim 1, wherein the antenna formed by the magnet core and winding has a quality parameter Q more than 50 in the frequency range from 20 kHz to 150 kHz.

11. The antenna according to claim 1, wherein the magnet core can be loaded with a magnetic flux of at least 20 μWb.

12. An antenna system comprising a plurality of antennas according to claim 1, wherein the magnet cores of the several antennas each carry a winding, wherein the radiation properties of the individual magnet cores are shaped and/or aligned differently.

13. The antenna according to claim 12, wherein at least one of the magnet cores has a recess for accommodating electronic components.

14. The antenna according to claim 1, wherein at least one of the magnet cores has a recess for accommodating electronic components.

15. An antenna arrangement comprising a magnet core and a cylindrical coil comprising several windings wound around the core, wherein the antenna is configured to transmit power inductively to one or more receivers positioned in a distance of about 0.5 cm to about 50 cm in any direction around the antenna arrangement, wherein the magnet core contains a soft magnetic component made of finely divided particles and a plastic component as the composite material and wherein the magnet core has an effective initial permeability ranging between 30 and 100 as well as a saturation induction higher than 0.6 T wherein the longitudinal axes of the windings are arranged at an angle greater than 0° to one another.

16. A method of using an antenna for inductive power transmission, comprising the steps of: providing an elongated magnet core with a soft magnetic component made of finely divided particles and a plastic component as the composite material, wherein the magnet core has an effective initial permeability ranging between 30 and 100 as well as a saturation induction higher than 0.6 T;

winding a cylindrical coil around said magnet core with a longitudinal axis of the coil parallel a length axis of the core; and transmitting power inductively by means of said antenna to a receiver over a distance of about 0.5 cm to about 50 cm.

17. The method according to claim 16 for inductive power transmission between a stationary device and a mobile device fitted with an inductive receiver.

18. The method according to claim 17 for charging the power stores in the mobile devices.

19. The method according to claim 16 for inductive power transmission from a mobile device to a stationary device.

* * * * *